US008388354B1

(12) United States Patent
Lin et al.

(10) Patent No.: US 8,388,354 B1
(45) Date of Patent: Mar. 5, 2013

(54) ELECTRICAL CONNECTOR

(75) Inventors: Jui-Pin Lin, New Taipei (TW); Ming-Chun Lai, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/308,712

(22) Filed: Dec. 1, 2011

(51) Int. Cl.
*H01R 13/60* (2006.01)

(52) U.S. Cl. ..... 439/39

(58) Field of Classification Search ..... 439/39, 439/38, 40
See application file for complete search history.

(56) References Cited

U.S. PATENT DOCUMENTS 6,623,276 B2 * 9/2003 Dalmau Ferrerfabrega et al. ..... 439/39
7,311,526 B2 * 12/2007 Rohrbach et al. ..... 439/39
7,625,213 B1 * 12/2009 Tse ..... 439/39
8,152,533 B1 * 4/2012 Lin ..... 439/39
8,241,043 B1 * 8/2012 Lin ..... 439/39
2002/0160629 A1 * 10/2002 Lau et al. ..... 439/39
2007/0161262 A1 * 7/2007 Lloyd ..... 439/39

* cited by examiner

*Primary Examiner* — Gary F. Paumen
(74) *Attorney, Agent, or Firm* — WPAT, P.C.; Anthony King

(57) ABSTRACT

An electrical connector includes an insulating housing having a front wall, a top wall, a bottom wall and two side walls. A rear surface of the front wall extends rearward to form a tongue portion. A receiving space is formed among the front wall, the top wall, the bottom wall and the side walls, wherein the tongue portion is located in the receiving space. A plurality of probe pins is assembled in the insulating housing. A magnetic block has a shape matched with the receiving space and is assembled in the receiving space. A metal plate is placed behind the magnetic block by passing a rear end of the tongue portion therethrough. A metal shell encloses the insulating housing and further electrically resists against a rear side of the metal plate to secure the magnetic block and the metal plate in the insulating housing.

9 Claims, 3 Drawing Sheets

ELECTRICAL CONNECTOR

BACKGROUND OF THE INVENTION

1. Field of the Invention

The present invention relates to an electrical connector, and more particularly to an electrical connector adapted to a mated connector by virtue of magnetic attraction.

2. The Related Art

A traditional electrical connector connected with a mated connector by magnetic attraction generally includes an insulating housing, a plurality of probe pins and a magnetic mechanism assembled in the insulating housing respectively. In use, the interconnection between the electrical connector and the mated connector is apt to be influenced by the magnetic force of the magnetic mechanism. However, the size of the magnetic mechanism often affects the magnetic force of the magnetic mechanism. Moreover, the rapid developments of electronic products call for more stringent requirements to miniaturization of the electrical connector. As a result, the traditional electrical connector generally fails to meet the requirements of both miniaturization and strong magnetic force at the same time.

SUMMARY OF THE INVENTION

Accordingly, an object of the present invention is to provide an electrical connector. The electrical connector includes an insulating housing, a magnetic block, a plurality of probe pins, a metal plate, and a metal shell. The insulating housing has a front wall, a top wall, a bottom wall and two side walls. The rear surface of the front wall extends rearward to form a tongue portion. A receiving space is formed among the front wall, the top wall, the bottom wall and the side walls, wherein the tongue portion is located in the receiving space. The insulating housing defines a plurality of inserting holes longitudinally penetrating through the front wall and the tongue portion. The magnetic block has a shape matched with the receiving space and is assembled in the receiving space. The probe pins are assembled in the inserting holes of the insulating housing respectively. The metal plate is placed behind the magnetic block by passing a rear end of the tongue portion of the insulating housing through the metal plate. The metal shell is mounted to the insulating housing to enclose the insulating housing, the magnetic block and the metal plate. The metal shell further electrically resists against a rear side of the metal plate to secure the magnetic block and the metal plate in the insulating housing.

As described above, the magnetic block is put forward into the receiving space of the insulating housing so as to make use of the inner space of the electrical connector effectively. So, it could be in favor of enlarging the size of the magnetic block so as to reinforce the magnetic attraction between the electrical connector and a mated connector, even though it is under the circumstances of no affecting the miniaturization of the electrical connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
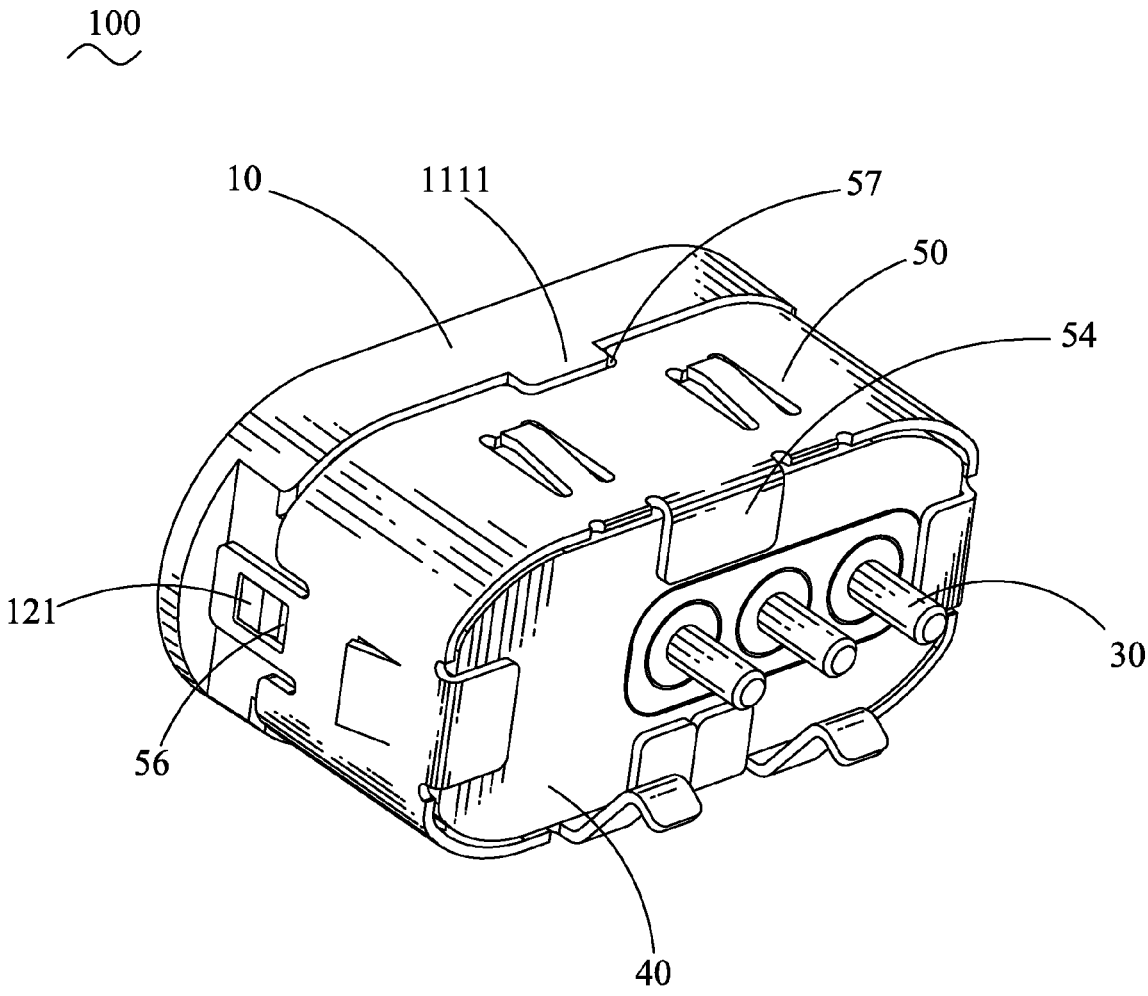
FIG. 1 is an assembled perspective view of an electrical connector according to the present invention.
Figure 2:
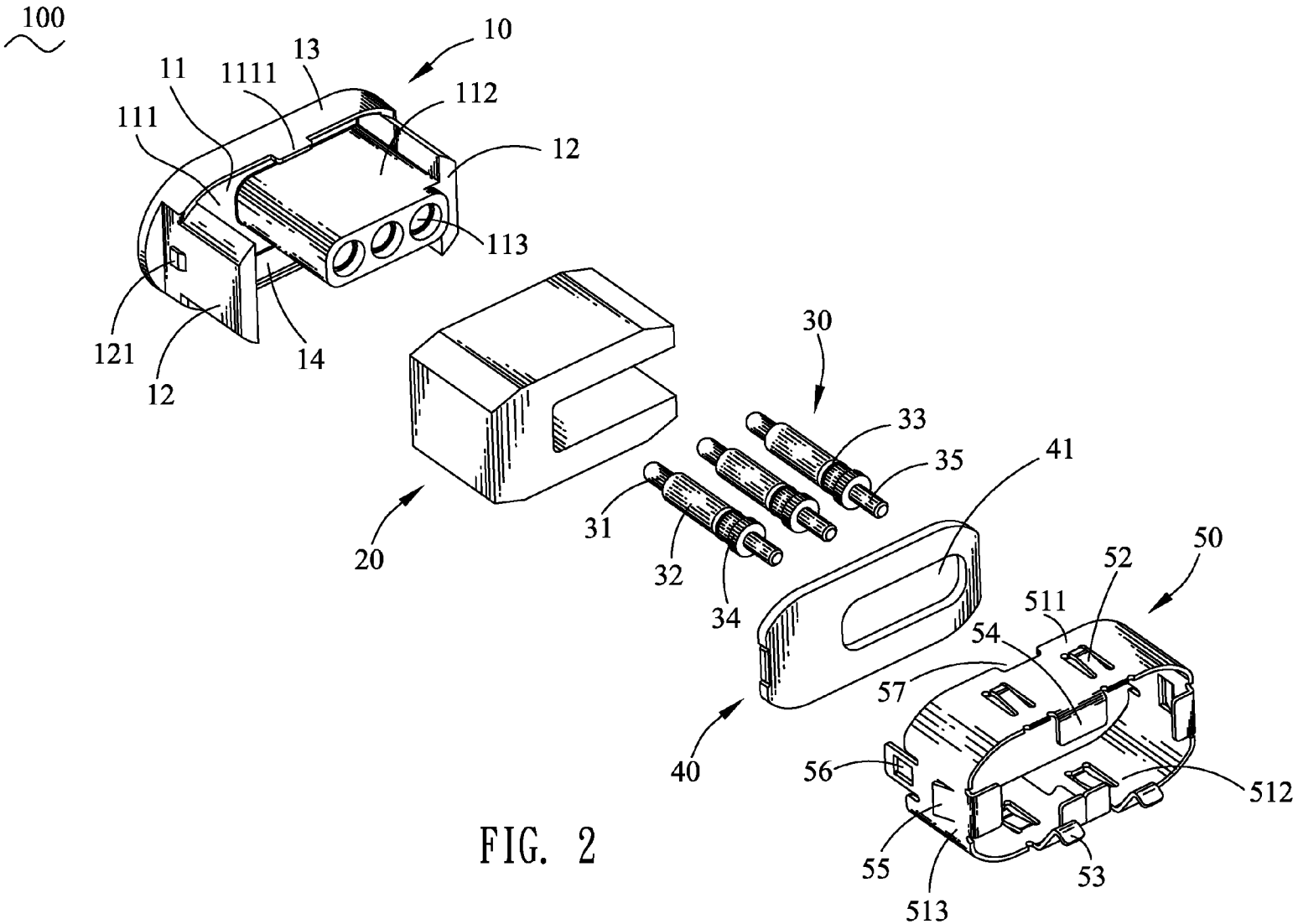
FIG. 2 is an exploded perspective view of the electrical connector of FIG. 1.

Referring to FIGS. 1-2, the electrical connector 100 includes an insulating housing 10, a magnetic block 20, a plurality of probe pins 30 assembled in the insulating housing 10, a metal plate 40, and a metal shell 50 enclosing the insulating housing 10.

Figure 3:
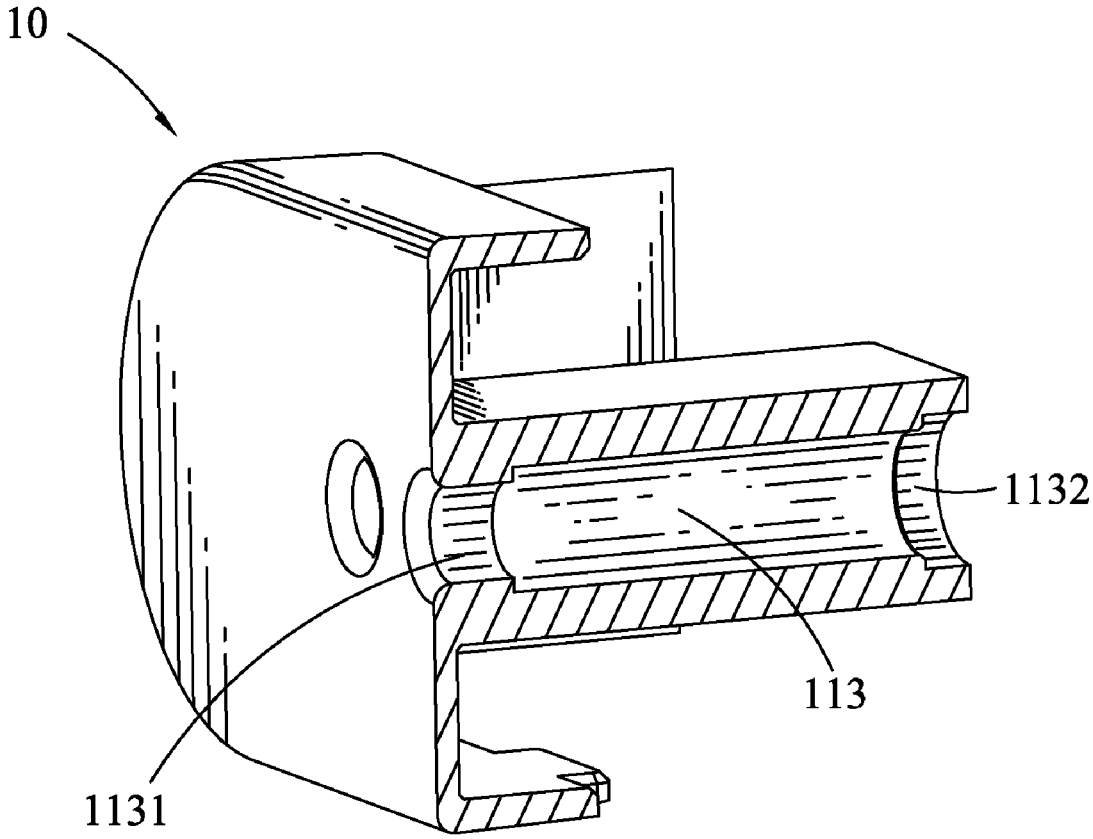
FIG. 3 is a cross-sectional view of an insulating housing of the electrical connector of FIG. 1.

With reference to FIGS. 2-3, the insulating housing 10 has a front wall 11 of substantially elliptic shape from a front view. A rear surface of the front wall 11 extends rearward to form a tongue portion 112 having a smaller dimension than the front wall 11. The insulating housing 10 defines a plurality of inserting holes 113 longitudinally penetrating through the front wall 11 and the tongue portion 112. An inner sidewall of the inserting hole 113 has a front portion thereof protruded inward to form a ring-shaped blocking wall 1131, and has a rear portion thereof concaved inward to form a circular blocking groove 1132. The rear surface of the front wall 11 has two opposite ends thereof protruded rearward to form a pair of side walls 12. An outside surface of the side wall 12 defines a buckle block 121 thereon. A top edge and a bottom edge of the front wall 11 extend rearward to form a top wall 13 and a bottom wall 14, respectively. The top wall 13 and the bottom wall 14 each has a shorter length than the side wall 12, and two opposite arc-shaped ends thereof are integrated with the corresponding side walls 12, so that a receiving space 111 is formed among the top wall 13, the bottom wall 14 and the side walls 12 wherein the tongue portion 112 is located in the receiving space 111. In this embodiment, the tongue portion 112 is integrated with a substantial middle of an inside surface of one side wall 12 and spaced among the top wall 13, the bottom wall 14 and the other side wall 12 to make the receiving space 111 show a substantial lying-U shape from a back view. A middle of a rear edge of the top wall 13 protrudes rearward to form a foolproof slice 1111.

Referring to FIG. 2, the magnetic block 20 is a unitary block having a shape matched with the receiving space 111 of the insulating housing 10. In this embodiment, the magnetic block 20 is of a substantial lying-U shape from a front view. The magnetic block 20 is put into the receiving space 111 to provide the electrical connector 100 with magnetic force so as to attract with a mated connector (not shown).

Referring to FIG. 2, each of the probe pins 30 includes a plunger 31 and a cylindraceous barrel 32 made of metal material. The barrel 32 has a rear end thereof sealed up and a front end thereof opened freely. The plunger 31 is retractably restrained in the barrel 32 by means of an elastic element (not shown) elastically positioned between the plunger 31 and the barrel 32, with a front end thereof stretching outside from the opened front end of the barrel 32. A periphery outside of the barrel 32 protrudes outward to form a ring-shaped blocking portion 34 at the rear end of the barrel 32, and a fastening portion 33 apart from the blocking portion 31 and having a smaller outer diameter than that of the blocking portion 34. The rear end of the barrel 32 extends rearward to form a soldering portion 35.

Referring to FIG. 2, the metal plate 40 has a substantially elliptic shape. A fixing hole 41 penetrates through the metal plate 40, and is opened to match with a rear end of the tongue portion 112 of the insulating housing 10.

Referring to FIGS. 1-2, the metal shell 50 is curved from a metal plate to show a substantially elliptic tubular shape, and has a top plate 511, two side plates 513, and two bottom plates 512 wedged with each other. The top plate 511 and the bottom plate 512 are punched outward to form a plurality of fixing arms 52 of which each has one end connected to the top plate 511 or the bottom plate 512 and the other end freely stretched outward. The top plate 511 defines a foolproof gap 57 at a front edge thereof, which is matched with the foolproof slice 1111 of the insulating housing 10. The rear edges of the bottom plates 512 extend rearward to form a plurality of touching tails 53 inclined upward in the process of extending rearward, with distal ends thereof being bent downward. A plurality of blocking plates 54 is perpendicularly bent inward from rear edges of the top plate 511, the bottom plates 512 and the side plates 513. The side plates 513 define a pair of fixing portions 55 oppositely protruded outward thereon, and a pair of buckle holes 56 opened in front ends thereof.

Referring to FIGS. 1-3, when assembling the electrical connector 100, the probe pin 30 is inserted forward in the inserting hole 113 of the insulating housing 10 with the front end of the barrel 32 resisting against a rear of the blocking wall 1131, the blocking portion 34 being positioned in the blocking groove 1132, and the fastening portion 33 abutting against an inner side of the inserting hole 113 to secure the barrel 32 in the inserting hole 113. The plunger 31 retractably stretches forward out of the inserting hole 113 and beyond a front side of the front wall 11 for electrically contacting with the mated connector. The soldering portions 35 project behind the tongue portion 112 for being soldered with an external printed circuit board (not shown). The magnetic block 20 is put forward into the receiving space 111 of the insulating housing 10. The metal plate 40 is placed behind the magnetic block 20, by inserting the rear end of the tongue portion 112 of the insulating housing 10 into the fixing hole 41. The metal shell 50 is mounted to the insulating housing 10 to enclose the insulating housing 10, the magnetic block 20 and the metal plate 40, by restraining the foolproof slice 1111 of the insulating housing 10 into the foolproof gap 57 and buckling the buckle blocks 121 of the insulating housing 10 into the buckle holes 56, respectively. The blocking plates 54 electrically resist against a rear side of the metal plate 40 to ensure a firm assembly of the magnetic block 20, the metal plate 40 and the insulating housing 10. The touching tails 53 of the metal shell 50 freely stretch behind the metal plate 40 for electrically connecting with the external printed circuit board.

As described above, the magnetic block 20 is put forward into the receiving space 111 of the insulating housing 10 so as to make use of the inner space of the electrical connector 100 effectively. So, it is in favor of enlarging the size of the magnetic block 20 so as to reinforce the magnetic attraction between the electrical connector 100 and the mated connector, even though it is under the circumstances of no affecting the miniaturization of the electrical connector 100.

What is claimed is:

1. An electrical connector, comprising:

an insulating housing having a front wall, a top wall, a bottom wall and two side walls, a rear surface of the front wall extending rearward to form a tongue portion, a receiving space being formed among the front wall, the top wall, the bottom wall and the side walls with the tongue portion being located in the receiving space, the insulating housing defining a plurality of inserting holes longitudinally penetrating through the front wall and the tongue portion;

a magnetic block having a shape matched with the receiving space of the insulating housing for being assembled in the receiving space;

a plurality of probe pins assembled in the inserting holes of the insulating housing respectively;

a metal plate placed behind the magnetic block by passing a rear end of the tongue portion of the insulating housing through the metal plate; and a metal shell mounted to the insulating housing to enclose the insulating housing, the magnetic block and the metal plate, the metal shell further electrically resisting against a rear side of the metal plate to secure the magnetic block and the metal plate in the insulating housing.

2. The electrical connector as claimed in claim 1, wherein the tongue portion of the insulating housing is integrated with a substantial middle of an inside surface of one side wall and spaced from the top wall, the bottom wall and the other side wall to make the receiving space show a substantial lying-U shape from a back view, and the magnetic block is a unitary block of a substantial lying-U shape matched with the receiving space.

3. The electrical connector as claimed in claim 1, wherein the metal shell is curved from a metal plate and has a top plate, two side plates and two bottom plates wedged with each other, a plurality of blocking plates is perpendicularly bent inward from rear edges of the top plate, the bottom plates and the side plates to electrically resist against the rear side of the metal plate.

4. The electrical connector as claimed in claim 3, wherein the top wall and the bottom wall each has a shorter length than the side wall, a middle of a rear edge of the top wall protrudes rearward to form a foolproof slice, the top plate of the metal shell defines a foolproof gap at a front edge thereof for restraining the foolproof slice therein.

5. The electrical connector as claimed in claim 3, wherein a pair of buckle holes is opened in the side plates of the metal shell respectively, an outside surface of each side wall of the insulating housing defines a buckle block buckled in the corresponding buckle hole of the metal shell.

6. The electrical connector as claimed in claim 3, wherein rear edges of the bottom plates of the metal shell extend rearward to form a plurality of touching tails inclined upward in the process of extending rearward, with distal ends thereof being bent downward, the touching tails freely stretch behind the metal plate.

7. The electrical connector as claimed in claim 1, wherein an inner sidewall of the inserting hole has a front portion thereof protruded inward to form a ring-shaped blocking wall, and has a rear portion thereof concaved inward to form a circular blocking groove, each of the probe pins includes a plunger, and a barrel made of metal material and having a front end thereof opened freely, the plunger is retractably restrained in the barrel with a front end thereof stretching outside from the opened front end of the barrel, a periphery outside of the barrel protrudes outward to form a ring-shaped blocking portion at a rear end thereof, the rear end of the barrel extends rearward to form a soldering portion, the probe pin is inserted forward in the inserting hole of the insulating housing with the front end of the barrel resisting against a rear of the blocking wall and the blocking portion being positioned in the blocking groove, the plunger retractably stretches forward out of the inserting hole and beyond a front side of the front wall, and the soldering portions project behind the tongue portion.

8. The electrical connector as claimed in claim 7, wherein the periphery outside of the barrel further protrudes outward to form a fastening portion apart from the blocking portion and having a smaller outer diameter than that of the blocking portion, the fastening portion abuts against an inner side of the inserting hole to secure the barrel in the inserting hole.

9. The electrical connector as claimed in claim 1, wherein a fixing hole penetrates through the metal plate and is opened to match with the rear end of the tongue portion of the insulating housing, the metal plate is mounted to the tongue portion and behind the magnetic block by inserting the rear end of the tongue portion into the fixing hole.

* * * * *